United States Patent [19]

Ishida

[11] 4,019,756

[45] Apr. 26, 1977

[54] BABY WALKER

[75] Inventor: Hajime Ishida, Tokyo, Japan

[73] Assignee: Tomy Kogyo Co., Ltd., Tokyo, Japan

[22] Filed: Aug. 18, 1975

[21] Appl. No.: 605,518

[52] U.S. Cl. ..... 280/649; 280/87.02 W; 280/650; 297/5

[51] Int. Cl.[2] ..... B62B 7/06

[58] Field of Search ..... 280/647, 649, 650, 87.05, 280/87.02 W, 657, 658; 297/5, 345; 248/164; 108/118, 119; 272/70.3

[56] References Cited

UNITED STATES PATENTS

| | | | |
|---|---|---|---|
| 1,342,518 | 6/1920 | Webber | 280/87.05 |
| 1,371,421 | 3/1921 | Hoffman | 280/87.05 |
| 2,770,288 | 11/1956 | Peyton | 280/87.05 X |
| 2,884,046 | 4/1959 | Patrick | 280/87.05 |
| 3,411,799 | 11/1968 | Felsher | 280/649 |
| 3,504,927 | 4/1970 | Seki | 280/650 X |
| 3,754,786 | 8/1973 | Boucher et al. | 297/5 |

FOREIGN PATENTS OR APPLICATIONS

| | | | |
|---|---|---|---|
| 439,787 | 9/1948 | Italy | 272/70.3 |

*Primary Examiner*—Joseph F. Peters, Jr.
*Assistant Examiner*—Michael J. Forman
*Attorney, Agent, or Firm*—Staas & Halsey

[57] ABSTRACT

There is disclosed a baby walker to be used by a child wherein the body of the child is supported above the ground so that the feet of the child are in contact with the ground, thus permitting the child to propel the baby walker. The baby walker comprises means for permitting the walker to be collapsed or expanded, and means for locking said collapsing and expanding means to fix top and bottom members of the baby walker in a desired one of several positions. In this manner, the seat supporting the child is adjustable so that the distance to the ground may be controlled for different sized children, or for the same child over a period of growth.

2 Claims, 10 Drawing Figures

BABY WALKER

BACKGROUND OF THE INVENTION

The present invention relates to a baby walker provided with a frame that rolls along the ground and a seat elevated at a height above the ground to the child. The child by moving its feet along the ground may thus propel the walker along the ground. With the present invention, it is also possible to collapse the frame permitting convenient storage of the walker as may be desirable when taking an automobile trip for example and to adjust the height of the frame and seat so as to accomodate the natural growth of the child.

DESCRIPTION OF THE PREFERRED EMBODIMENT

Figure 1:
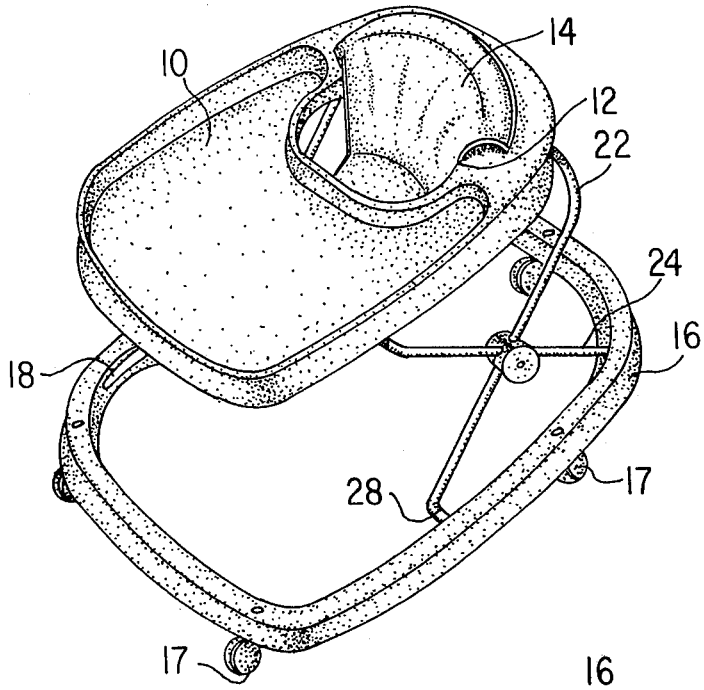
FIG. 1 is a perspective view of the walker in raised position.

As illustrated in FIG. 1, the baby walker or stroller consists of a top member 10 provided with an opening 12 and a seat 14 suspended below the opening 12 in such manner as to support the child. The reference numeral 16 designates the bottom member which is provided on the underneath side with a plurality of rollers 17 permitting the bottom member 16 to move along a surface. The construction previously described is known in the prior art and need not be explored in detail.

Figure 2:
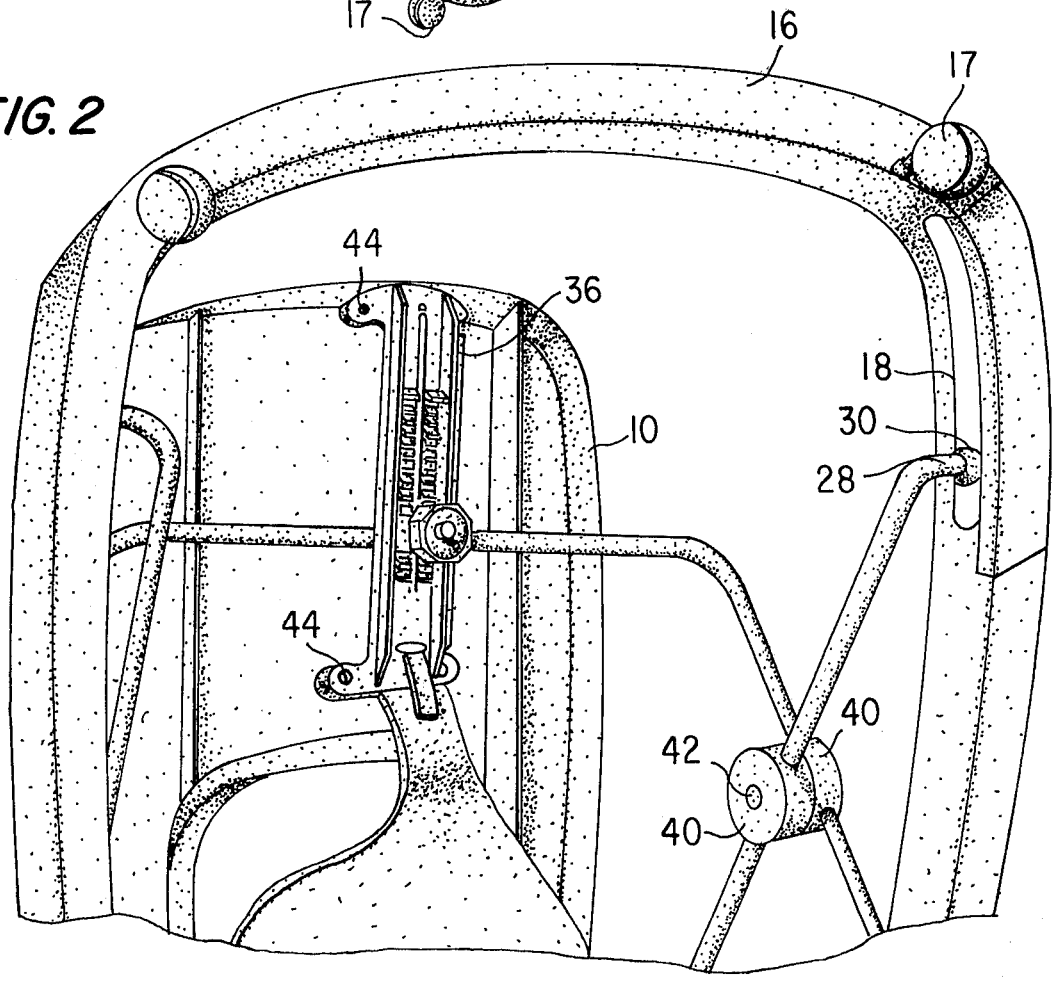
FIG. 2 is a perspective view of a portion of the walker viewed from the bottom thereof illustrating the manually operable mechanism for adjusting the height of the frame and seat and for collapsing the entire walker for transport.
Figure 3:
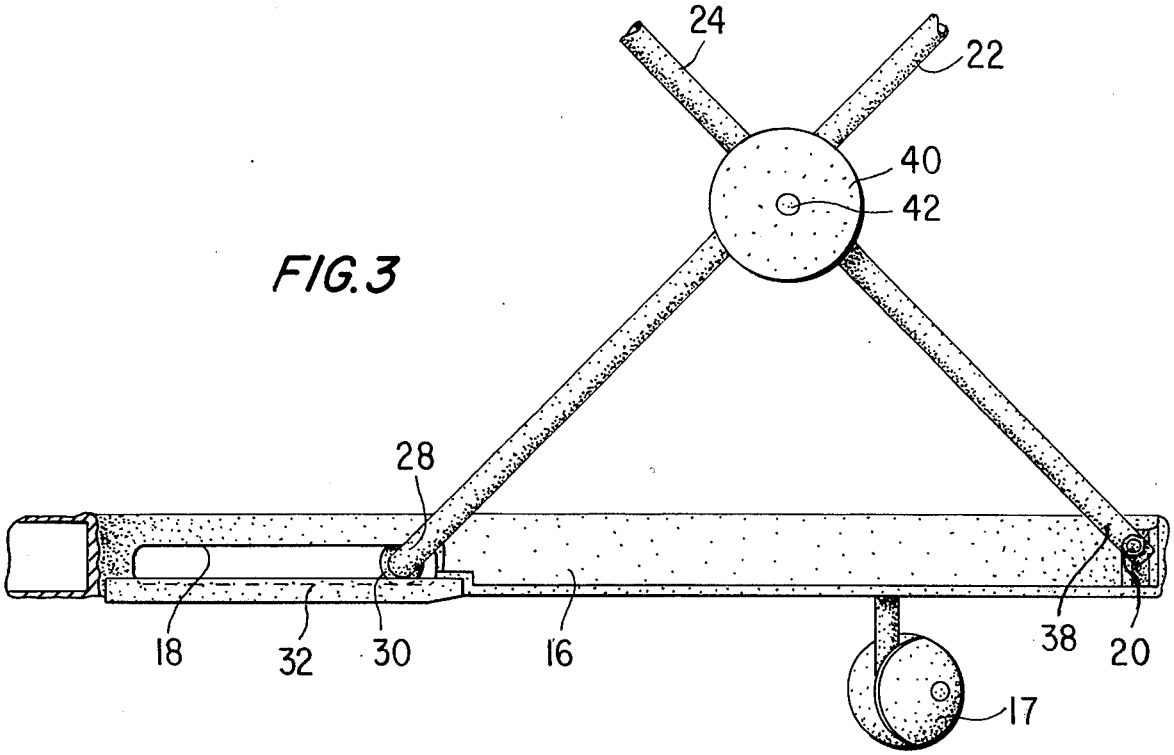
FIG. 3 is a side elevational view partly in section of one side of the bottom member of the frame illustrating the relationship of the sliding and rotating struts to the bottom member of the frame when the struts are positioned in such manner as to raise the top frame member to its uppermost position.
Figure 4:
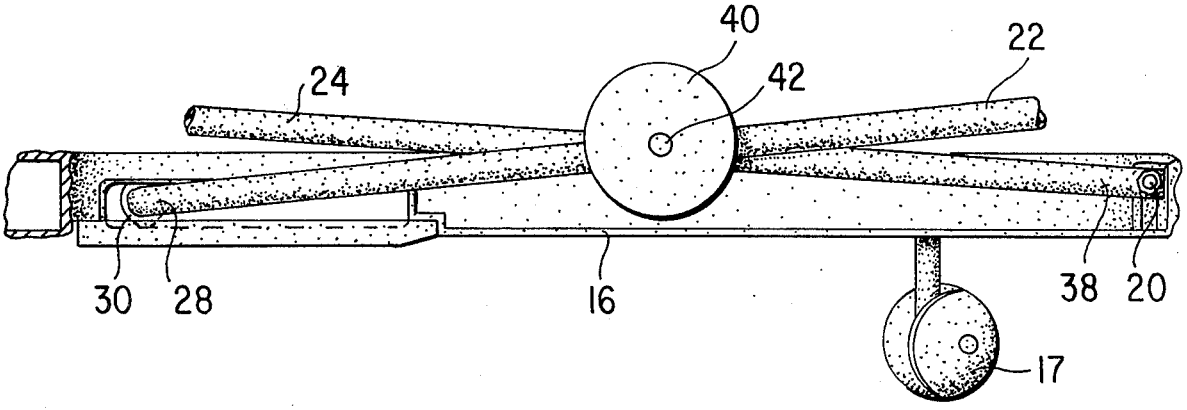
FIG. 4 is a side elevational view partly in section illustrating the relationship of the struts to the bottom member of the frame when the top frame member is in collapsed position for storage.

As illustrated in FIGS. 2–4, the inner portions of the side walls of the bottom member 16 are provided with longitudinal slots 18 defining cavities within the walls, and pins 20. The top and bottom members 10 and 16, respectively, are operably connected to each other with the struts 22 and 24, as will now be described.

Figure 10:
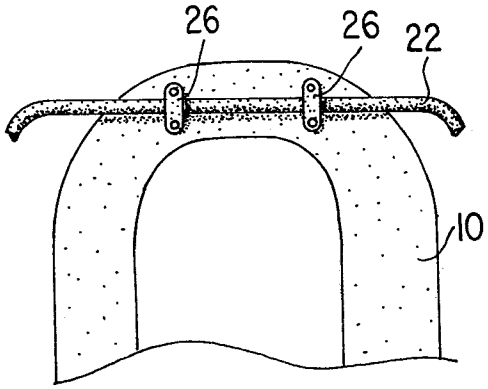
FIG. 10 is a bottom plan view of a portion of the walker illustrating the arrangement wherein one of the struts in mounted for rotation to the underneath surface of the rear of the top frame member.
Figure 7:
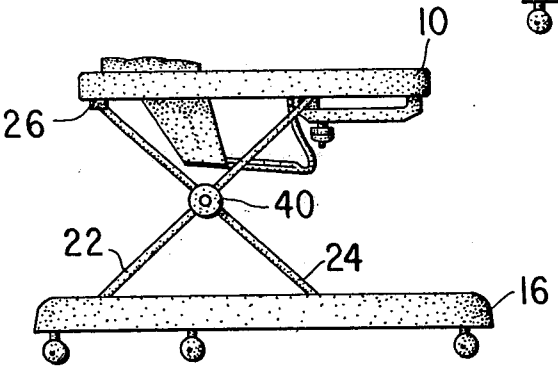
FIG. 7 is a side elevational view illustrating the walker in fully raised position wherein the top frame member is positioned at the maximum permissible height above the lower frame member.
Figure 9:
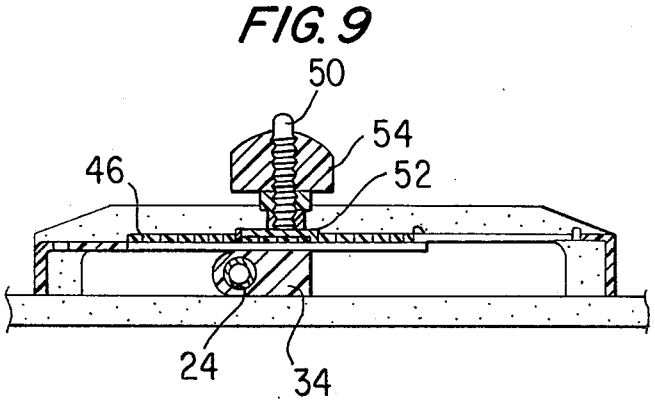
FIG. 9 is a sectional view taken along lines 9–9 of FIG. 8 illustrating the mechanism for top frame member in the selected position.

The strut 22 is journalled for rotation within blocks 26 which are secured to the underneath surface of the rear of the top member 10, as illustrated in FIGS. 7 and 10. The strut 22 terminates in lower ends designated by the reference numeral 28, each of which passes through its corresponding slot 18 into the cavity within the walls of the bottom member 16. Each of the ends 28 of the strut 22 is provided with a roller 30, as illustrated in FIGS. 3 and 4, which is positioned within the cavity to thus serve the dual purpose of fixedly securing the end 28 in relationship to slot 30 while permitting the roller 30 to move along the bottom surface 32 of the cavity defined by the slot 18. The strut 24, as illustrated in FIG. 9, is mounted to rotate within a block 34 that is mounted to move longitudinally below the top member 10 along the rail 36. The strut 24 terminates downwardly in ends 38 which are provided with openings through which the pins 20 extend thus permitting the ends 38 to rotate about the pins 20.

The struts 22 and 24 intersect on each side of the walker at the rotating cylinders 40. From FIG. 2, it will be apparent that the struts 22 and 24 pass through their respective cylinders 40, while the pin 42 connects the cylinders 40 to each other. In this manner, as the struts 22 and 24 adopt different positions, to be described hereinafter, their respective cylinders 40 rotate about the pin 42.

Figure 8:
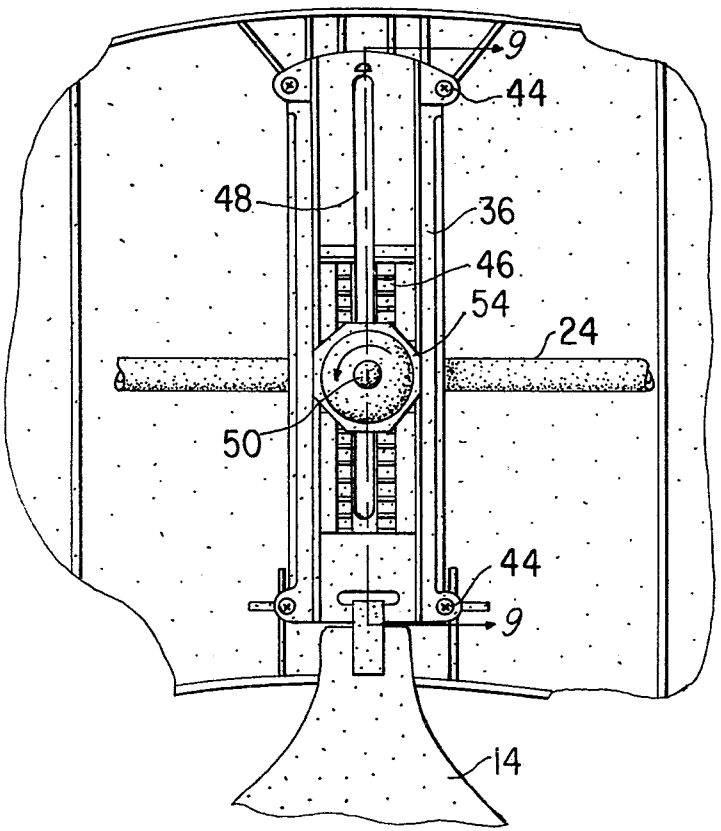
FIG. 8 is a bottom plan view of a portion of the walker illustrating in detail the manually operable mechanism for adjusting the height of the top frame member relative to the lower frame member.

With reference to FIGS. 2 and 8, it is apparent that the rail 36 is appropriately mounted, for example by screws 44, to the underneath side of the top member 10. The rail 36 is provided with a plurality of teeth 46 located on opposite sides of the slot 48. The block 34, which as illustrated in FIG. 9 is arranged to slide between the underneath surface of the top member 10 and the rail 36, is provided with a screw-threaded shaft 50 which passes through the slot 48 of the rail 36 and an opening located within the latching member 52 which is provided with teeth 54 which mesh with the teeth 46 of the rail 36. A knob 54 is appropriately threaded on the shaft 50 such that as it is turned is one direction the latching member 52 is forced downwardly into engagement against the rail 36 until the respective teeth 54 and 46 engage at which time the block 34 is locked in position. It will also be apparent that as the knob 54 is rotated in the opposite direction the teeth 54 and 46 disengage and it is possible to move the block 34 and the strut 24 which passes therethrough longitudinally along the underneath surface of the top member 16.

As illustrated in FIGS. 3 and 4, as the position of the block 34 is changed, the ends 28 of the strut 22 slide along the bottom member 16 and the ends 38 of the strut 24 rotate about the pins 20.

Figure 5:
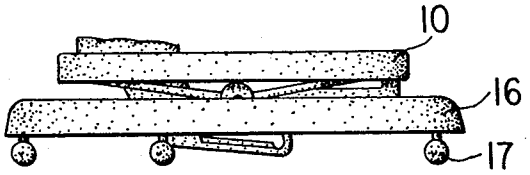
FIG. 5 is a side elevational view illustrating the walker in collapsed position for storage.
Figure 6:
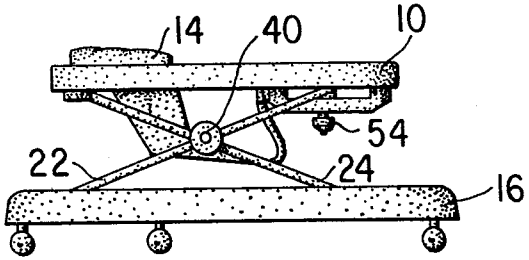
FIG. 6 is a side elevational view illustrating the walker in one of several distinct raised positions.

Turning now to FIGS. 5–7, it will be apparent that as the knob 54 is loosened disengaging the teeth 46 and 54 it is possible to collapse the walker to the position illustrated in FIG. 5 wherein the top and bottom members 10 and 16, respectively, are positioned near each other. Thus, the walker may be conveniently stored which is particularly helpful when it is desired to store the walker in an automobile during a trip. FIGS. 6 and 7 illustrate various stages of raising the height of the walker, it being understood that the teeth 46 and 54 coact to define a series of distinct positions between the collapsed position illustrated in FIG. 5 and the fully raised position illustrated in FIG. 7. The foregoing is significant since it will be apparent that as the child grows taller it is not necessary to discard the walker and acquire a larger one but rather it is only necessary to change the setting of the block 34 the result of which is to progressively raise the height of the top member 10 relative to the bottom member 16. In this manner, a single walker may be used even though the child grows taller.

I claim:

1. A walker, comprising:

a top member provided with an opening therein and a seat suspended below said opening;

a bottom member;

means operably connecting said top and bottom members for permitting the walker to be collapsed, wherein said top and bottom members are positioned near each other, and for permitting the walker to be expanded through several positions wherein the distance between said top and bottom members is variably adjusted, said collapsing and expanding means comprises a first strut having a top portion mounted to said top member for rotation about a fixed axis and a bottom portion consisting of arms, said bottom member including means for mounting said arms of said first strut to slide with respect to said bottom member, said collapsing and expanding means also comprising a second strut having a top portion and a bottom portion consisting of arms, said top member including means permitting said top portion to slide along the underneath of said top member, said bottom member including means for mounting said arms of said second strut to rotate about fixed points on said bottom member, said struts having intermediate portions between said top and bottom portions intersecting each other on each side of said walker, said top member slide means comprises a block, wherein said top portion of said second strut passes through said block and is mounted to rotate about an axis through said block, a rail mounted longitudinally below said top member, said block mounted to slide along said rail, and means located on said top member for locking said collapsing and expanding means to set said top and bottom members in a desired one of said positions, wherein said locking means comprises a series of teeth along said rail, a threaded post extending outwardly from said block, a knob threaded on said post, and a member intermediately adjacent said rail and said knob provided with teeth complementary in configuration with respect to said teeth of said rail, such that as said knob is threaded on said post said knob forces said teeth of said member into engagement with said teeth of said rail prohibiting said top portion of said second strut from sliding, thereby locking said collapsing and expanding means in one of said several positions.

2. A walker as in claim 1, including means for permitting said bottom member to roll along a surface.

* * * * *